United States Patent [19]

Singer

[11] 4,399,957

[45] Aug. 23, 1983

[54] YARN PACKAGE HOLDER

[76] Inventor: Hans S. Singer, 191 Inglewood, Greenville, S.C. 29615

[21] Appl. No.: 326,765

[22] Filed: Dec. 2, 1981

[51] Int. Cl.[3] ..... B65H 49/10; D02H 1/00; D03J 5/16

[52] U.S. Cl. ..... 242/130; 242/131

[58] Field of Search ..... 242/130.1, 130.2, 131, 242/131.1, 129.5, 129.7, 130, 46.2; 279/2 R, 1 DC, 1 DA; 211/4; 224/37; 24/137 R, 262

[56] References Cited

U.S. PATENT DOCUMENTS 3,850,394 11/1974 Raasch et al. ..... 242/129.7
3,858,827 1/1975 Glassbrook ..... 242/131
3,951,353 4/1976 Jenkins ..... 242/129.7
4,120,526 10/1978 Rohner ..... 242/130.2 X

FOREIGN PATENT DOCUMENTS 884111 12/1961 United Kingdom ..... 242/131

*Primary Examiner*—Stuart S. Levy
*Assistant Examiner*—Scott J. Haugland
*Attorney, Agent, or Firm*—Ralph Bailey

[57] ABSTRACT

A holder for positioning yarn packages as upon creels and the like, is illustrated wherein the yarn packages each include a carrier having an outwardly extending lip wherein the lip is received in wedging engagement between a pair of supports at a single point or position about the circumference of the lip.

2 Claims, 2 Drawing Figures

YARN PACKAGE HOLDER

BACKGROUND OF THE INVENTION

This invention relates to a holder for positioning yarn packages such as cones, tubes or bobbins having an outwardly extending circumferential lip. The bobbins are positioned upon magazine supports or creels feeding yarn as to looms, knitting machines, twisters, texturizing machines, warping or winding, for example. Present apparatus for creeling such yarn packages includes most commonly pins, but creels having pin holders possess the disadvantage of being relatively inaccessible since the package must be passed by the operator about the end of the relatively long pin for placement. As an aid in doing this, the pins have been positioned upon swingable arms, but these devices are complicated and possess a further disadvantage that unless they are returned to proper alignment, increased tension is exerted upon yarn being fed therefrom to the textile machine. Other apparatus for receiving the yarn carrier such as tubes or cones, include springs or other elements for internal reception within the yarn carrier. A structure having a spring with a core projecting into the yarn carrier is illustrated in U.S. Pat. No. 3,850,394. U.S. Pat. No. 3,951,353 illustrates an apparatus for supporting a bobbin wherein the entire butt portion of the bobbin is supported between a stationary member and a spring biased inwardly projecting member. In this latter bobbin support assembly, the entire base of the yarn carrier is engaged between the holding members.

Accordingly, it is an important object of the present invention to positively position a yarn carrier in any desirable position such that same may be wedgingly engaged at one point about the circumference of the lip of the yarn carrier so as to position the yarn carrier in any desirable position, even upside down.

Another object of the invention is to provide a versatile positioner for yarn packaging as in creeling, wherein any size and shape package including cones and cheeses may be positioned providing an outwardly extending lip is provided by the yarn carrier for wedging engagement in a given position about the circumference of the lip.

Another important object of the invention is to provide a more economical creeling system which will reduce labor requirements as well as capital expenditure.

SUMMARY OF THE INVENTION

It has been found that a yarn holder may be provided for positively positioning a yarn package having a carrier with an outwardly projecting lip by providing a pair of wedging members, at least one of which is displaceable upon insertion of the lip of the yarn carrier between the wedging members so that a manually releasable wedging force is exerted upon the lip for positively positioning the yarn carrier. It is important the at least one of the wedging members be movable and project inwardly so as to be displaceable upon the insertion of the bobbin and that such members be suitably supported as upon a mounting plate or integrally as a part of a creel structure. The holder may be positioned upon a creel or may be positioned upon a magazine type support or creel as for feeding a loom as illustrated in the particular embodiment described herein.

It is to be understood that the elements of the holder must be positioned by a suitable support means for functioning together to exert a gripping force positioning the package for delivering yarn as desired to a textile machine.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
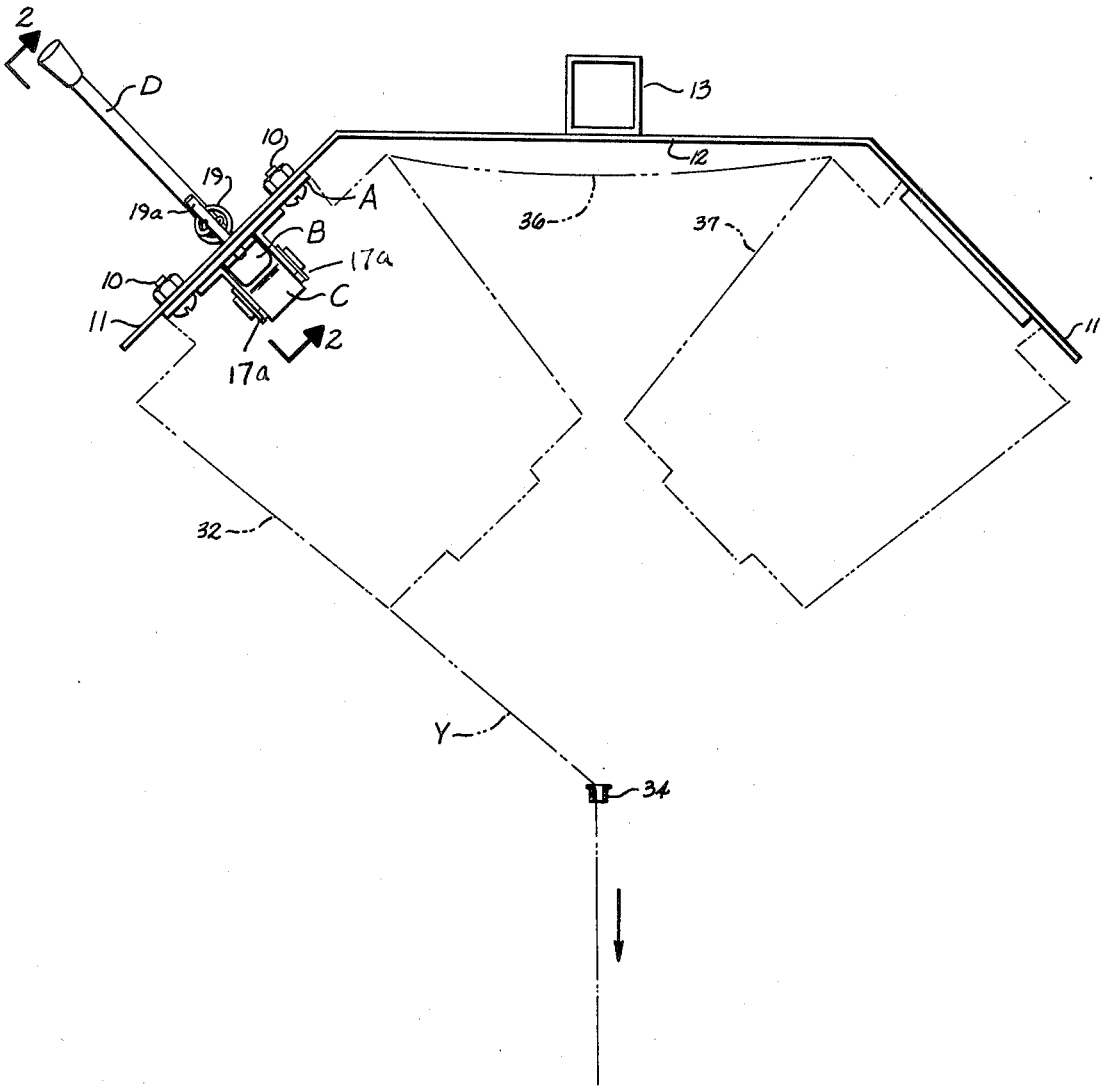
FIG. 1 is a plan view illustrating a magazine type arrangement, including yarn holders constructed in accordance with the present invention and supplying yarn as to a loom.

The drawing illustrates a holder for positioning yarn packages as upon creels and the like. The yarn packages include a yarn carrier having an outwardly extending annular lip. A support A is illustrated in the form of a mounting plate. A first outwardly extending lip receiving wedging member B is carried by the support. A second lip receiving wedging member C is carried opposite the first wedging member displaceable upon insertion of the lip between the first and second wedging members for exerting a positive gripping action upon the lip therebetween. Manually operable means D is connected to at least one of the wedging members for releasing the gripping action exerted by the wedging members upon the lip. Thus, a yarn package may be conveniently received upon the holder by manual insertion of the lip between the wedging members B and C for positive, manually releasable positioning of the package by exerting a gripping action upon the lip.

The support A has openings therein for mounting the bracket as by threaded fasteners 10 upon angled supports 11 which are bridged at 12 for suitable securement to a vertical post 13 (FIG. 1).

The first outwardly extending lip receiving wedging member B is provided in the form of a leg of a bracket which includes a mounting flange 14, which is attached as by welding at 15 to the support plate A. A pair of spaced bracket members 16 are suitably secured to the support A and these spaced brackets 16 hold the stud 17 as by any suitable means such as a pressed fit or retaining members **17*a* carried in grooves in the pin or stud 17, for pivotally supporting an annular element 18** which carries the second lip receiving wedging member C. The wedging member C has fixed attachment to the pivotal member so as to preferably cause the wedging member C to project inwardly toward the fixed wedging member B during operation.

A resilient force is applied to the annular support member 18 through the manually operable means D, which is illustrated as being provided in the form of an operating lever which has connection with the pivotal support 18. A coil spring 19 is connected intermediate the ends of the operating lever D, and is connected on the other end to a bracket **19*a* which is carried by the support plate A, and which extends through the mounting bracket 11 through a slot 20 therein. The slot extends downwardly to accommodate the lever D. The lever D is limited in its upward travel by the lower edge 21 of a slot within the support plate A, which extends downwardly sufficiently to permit manual depression of the lever for moving the second wedging member C downwardly in FIG. 2**.

Figure 2:
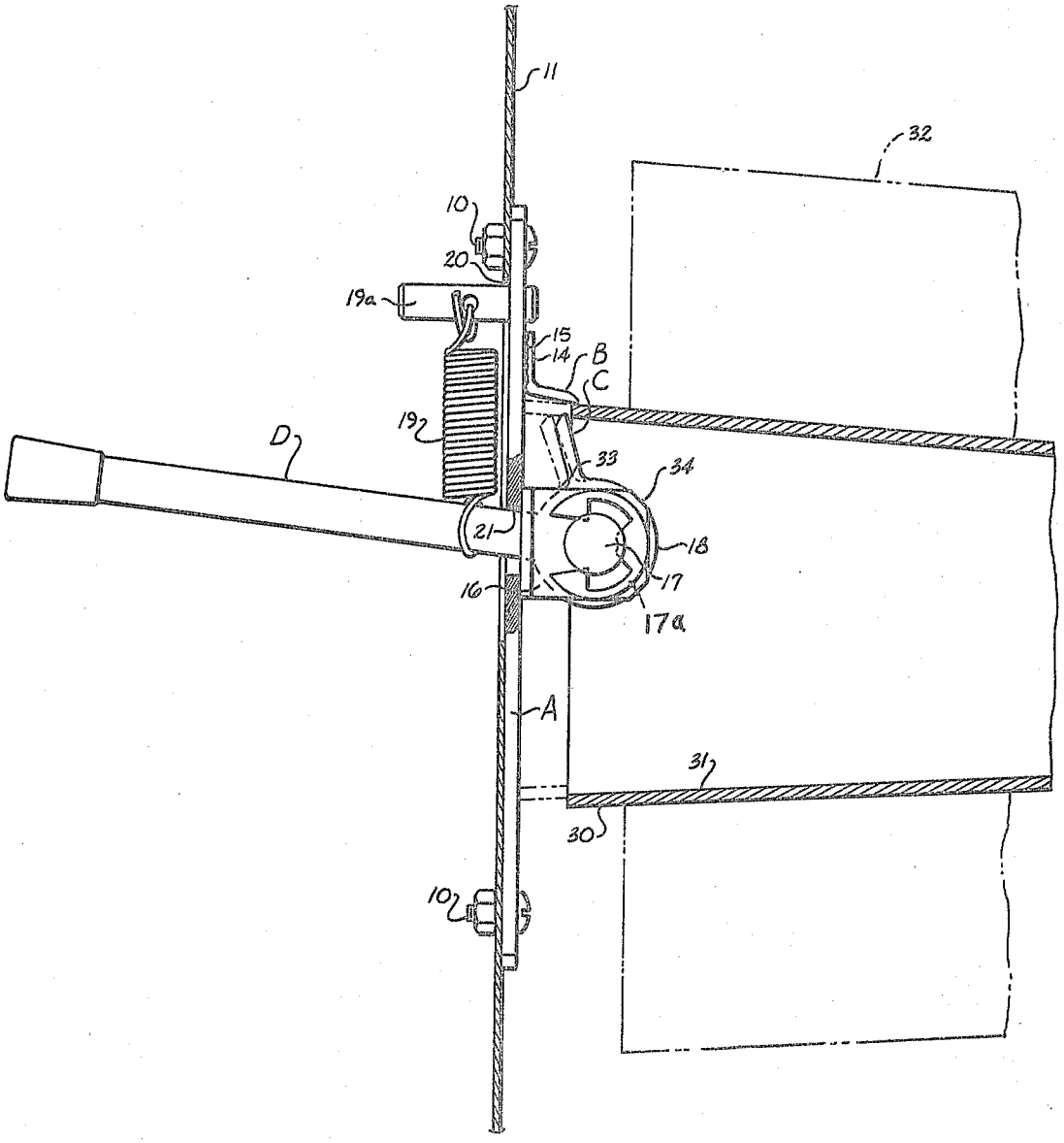
FIG. 2 is a sectional elevation taken on the line 2—2 in FIG. 1.

The second wedging member C is positioned in FIG. 2 as having just received the lip 30 of the yarn carrier which has an inner bore 31 and which carries convolutions of yarn 32 thereon. The lip 30 at one point or location, is wedgingly received between the first and second wedging members B and C, respectively, by pressing inwardly upon the yarn package after which the lip passes over the free end of the second wedging member C and is positively positioned then between the wedging members.

In order to facilitate insertion of the yarn carrier within the holder, a pair of camming or guiding surfaces 33 are provided upon the brackets 16. If desired, the lip may be rested upon the opposite horizontal portions 34 of the brackets 16 preparatory to sliding same inwardly depressing the wedging member C as it passes thereover for wedging engagement against the first or stationary wedging member B. It is important that the lip be pressed inwardly so as to seat against the support A. Thus, a support is provided for the lip opposite the wedging or gripping action. If the structure as illustrated is utilized, the gripping action becomes stronger against a force tending to dislodge or pull out the lip.

Referring again to FIG. 1, it may be noted that the yarn packages may be positively positioned against rotation for supplying yarn Y as to a loom through the eyelet schematically illustrated at 34*a*. A length of yarn 36 is illustrated as being connected to a reserve package 37 containing yarn which will be fed to the loom after exhaustion of the yarn 32.

It is thus seen that a holder of simple construction has been provided for a creel accessible to the operator for positively positioning a yarn carrier through the use of package holders of the type illustrated herein, wherein the creeling operation no matter of what type, may be considerably simplified.

While a preferred embodiment of the invention has been described using specific terms, such description is for illustrative purposes only, and it is to be understood that changes and variations may be made without departing from the spirit or scope of the following claims.

What is claimed is:

1. A holder for positioning yarn packages as upon creels and the like, said yarn packages including a yarn carrier having an outwardly extending annular lip comprising:

a support;

a first outwardly extending lip receiving wedging member carried by said support;

a second inwardly extending lip receiving wedging member pivotally carried upon said support opposite said first wedging member displaceable upon insertion of said lip in the direction of insertion of the lip between said first and second wedging members for exerting a positive gripping action upon said lip therebetween;

resilient means urging said second wedging members toward said first wedging members;

manually operable means for releasing the gripping action exerted by said wedging members upon said lip;

bracket members fixed to said support-pivotally carrying the second wedging member therebetween; and camming means opposite said second wedging member guiding said lip between said wedging members;

whereby a yarn package may be conveniently received upon said holder by manual insertion of the lip between the wedging members for positive, manually releasable positioning of the package by exerting a gripping action upon the lip.

2. The structure set forth in claim 1 wherein said manually operable means includes an operating lever connected to said second wedging member for manually overcoming the force of said resilient means for releasing the grip exerted by said wedging members.

* * * * *